US008448590B2

(12) United States Patent
Fernandez Puentes

(10) Patent No.: US 8,448,590 B2
(45) Date of Patent: May 28, 2013

(54) TUNNEL RIGGING

(75) Inventor: Gonzalo Fernandez Puentes, Madrid (ES)

(73) Assignee: Inversail, S.A., Madrid (ES)

( * ) Notice: Subject to any disclaimer, the term of this patent is extended or adjusted under 35 U.S.C. 154(b) by 197 days.

(21) Appl. No.: 12/991,195

(22) PCT Filed: Apr. 30, 2009

(86) PCT No.: PCT/ES2009/000231

§ 371 (c)(1),
(2), (4) Date: Nov. 5, 2010

(87) PCT Pub. No.: WO2009/135969

PCT Pub. Date: Nov. 12, 2009

(65) Prior Publication Data

US 2011/0048307 A1 Mar. 3, 2011

(30) Foreign Application Priority Data

May 5, 2008 (ES) ..... 200801271

(51) Int. Cl.
*B63B 15/00* (2006.01)
*B63H 9/10* (2006.01)

(52) U.S. Cl.
USPC ..... 114/92

(58) Field of Classification Search
USPC ..... 114/39.21, 39.29, 39.32, 102.1, 102.12–102.16, 108–115, 89–92, 97–100
See application file for complete search history.

(56) References Cited

U.S. PATENT DOCUMENTS

| | | | | |
|---|---|---|---|---|
| 685,943 | A * | 11/1901 | Pool | 114/39.29 |
| 2,147,501 | A * | 2/1939 | Ryder | 114/39.32 |
| 3,838,655 | A * | 10/1974 | Kratz | 114/39.32 |
| 3,968,765 | A | 7/1976 | Menegus | |
| 4,047,493 | A * | 9/1977 | Menegus | 114/102.16 |
| 6,575,107 | B1 | 6/2003 | Fernandez Puentes | |
| 2002/0139285 | A1 | 10/2002 | Ward | |

FOREIGN PATENT DOCUMENTS

| | | |
|---|---|---|
| GB | 2229984 | 10/1990 |
| JP | 2068290 A | 3/1990 |

OTHER PUBLICATIONS

International Search Report, Int'l Application No. PCT/ES 2009/000231, Aug. 31, 2009.

* cited by examiner

*Primary Examiner* — Daniel Venne
(74) *Attorney, Agent, or Firm* — Cook Alex Ltd.

(57) ABSTRACT

A self-supporting rotary rigging and, more specifically, a rigging that has a circular platform adjacent to the deck of the vessel, which makes it possible to control the rotation of the rigging and to install rotary stays and shrouds, which assists in stabilizing the rigging. The rigging is characterized by the existence of a small common boom securely joined to the base platform and to which are fastened the backstay and forestay, all the aforesaid making the rigging very secure and enabling the backstay and forestay to be capable of downward movement. There is a base crosstree, likewise securely connected to the platform, perpendicular to the stays, and to the end thereof are fastened the shrouds, enabling the later to work at a suitable angle. In addition, there is a tunnel across the lower part of the mast, which allows passage from one side of the rigging to the other.

7 Claims, 6 Drawing Sheets

TUNNEL RIGGING

1.—BACKGROUND OF THE INVENTION

Figure 1:
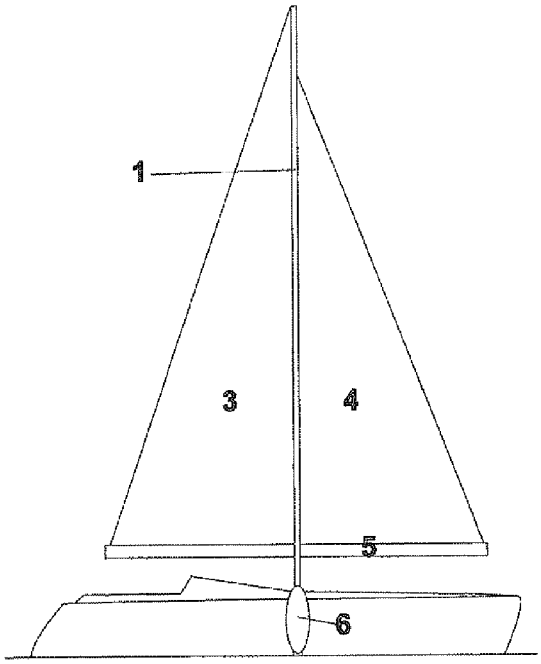

This invention aims to be another improvement in the field of "Self-Supported Rotating Rigs", calling by this name those sailing rigs in which the mainsail boom extends in front of the mast, bending a self-tacking jib to this common boom (5), rotating the whole set of: mast (1), boom and sails simultaneously around a sensibly vertical axis, and being the whole rig supported by a rotating rig connection (6) to the boat's hull without having to use shrouds or stays (FIG. 1).

Among others, this type of rigs has been already used in 1975 by K. R. May under the name of Boomsprit and later by Carbospars Ltd under the name Aero-Rig.

Figure 2:
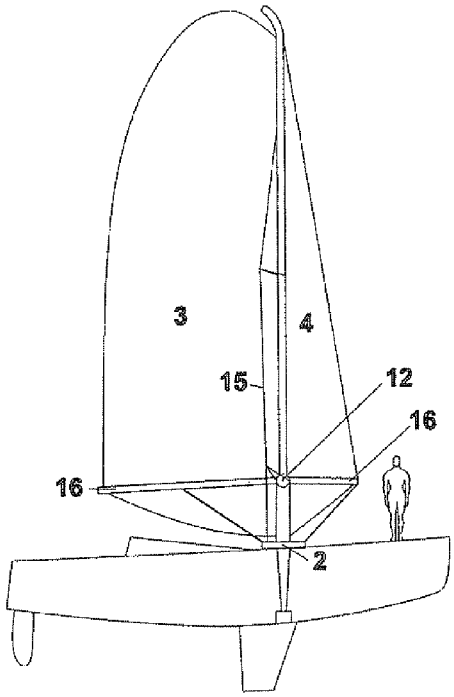
Figure 3:
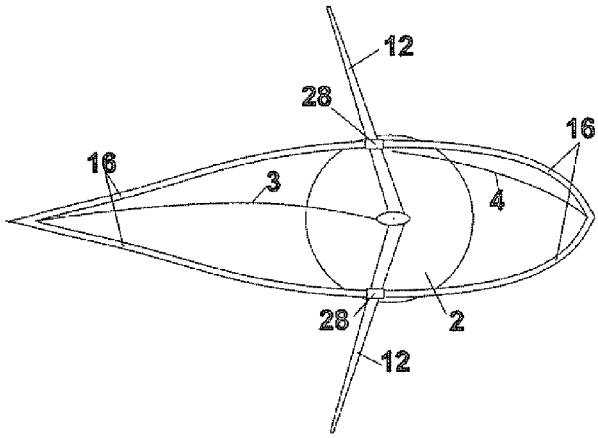
Figure 4:
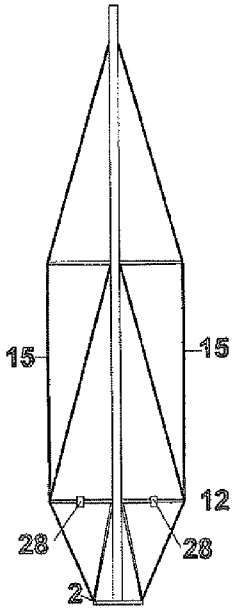

In 1999 we, Inversail, S. A., disclosed a new rig, much improved, under the name of Spindle-Rig, filing the corresponding patent application: "Improvements to rotary gear for sailing boats" (WO 0104000). (FIGS. 2, 3 and 4). Characteristics of this rig were: A platform (2) at the base of the rig, next to the ship's deck, which allowed the rig's rotation control, and rotating shrouds (15) which from the said platform permitted the stabilization of the mast. Another important feature of this rig was the use of two wishbone-type booms (16), one for the mainsails (3) and another one for the jib (4), being these booms hinged connected (28) to a first crosstree (12) placed above people's heads, which permitted the independent up and down movement of the mainsail boom, and also that the sails could come down even to deck level, thus lowering the centre of effort and making the sails more accessible.

Nevertheless, when we started the development and building of this rig we realized that the wishbone booms and their hinged connection to the first crosstree was not a good solution because the enormous horizontal rotating torques created by the wind in both booms had to be absorbed through this delicate connection. Also access to the said booms was rather difficult when reefing and especially in emergency situations.

2.—DESCRIPTION OF THE INVENTION

Figure 5:
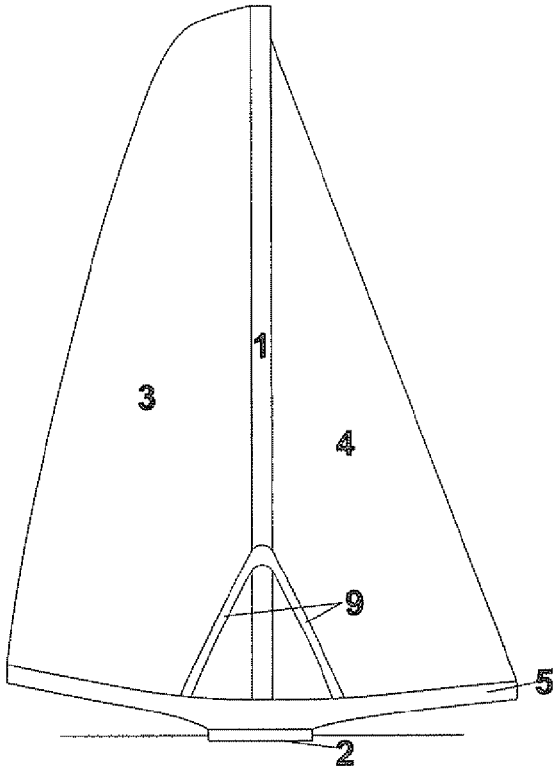

In order to avoid these problems, we now propose the replacement of the two wishbone booms by a single common boom (5) monolithic and directly connected to the base platform. This boom increases its distance to the deck as it goes away from the mast (FIG. 5).

The common boom should be wide in order to be capable of absorbing the great horizontal torques created by the sails and in order to allow them to reach the deck. There are as well longitudinal reinforcements (9) between said boom and mast for the absorption of the vertical tension created by the sails. These reinforcements are laterally separated in order to allow for the sails to come down even to platform level, and there are four reinforcements, two for the jib area and two for the main sail area.

Figure 6:
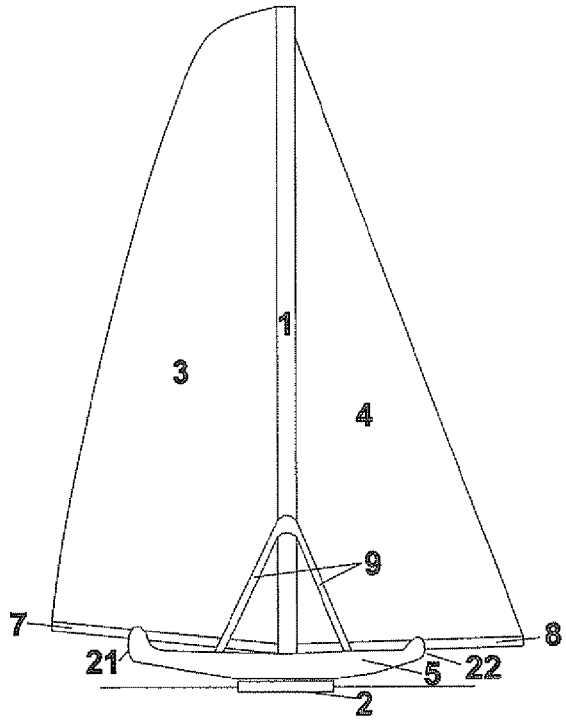

This solution would allow us to solve the structural fragility of the hinged connection of the previous patent but, would not allow us to variate the distance to the deck and the inclination of the mainsail foot. In order to solve this problem, we propose to add a mainsail boom (7), connected to the common boom in the area of the mast and in its posterior part (21). Actually what we have is a short common boom to which a mainsail boom is connected. The mainsail is bent to this mainsail's boom, and the said movements allow us to increase or reduce the mainsail vertical tension, and indirectly, the tensions of the jib's luff through the top of the mast (FIG. 6).

There is also a jib's boom (8), with a similar function to the mainsail's boom with special accent on a possible telescopic sliding, in order to permit the use of jibs with shorter or longer luff. (FIG. 6)

Figure 7:
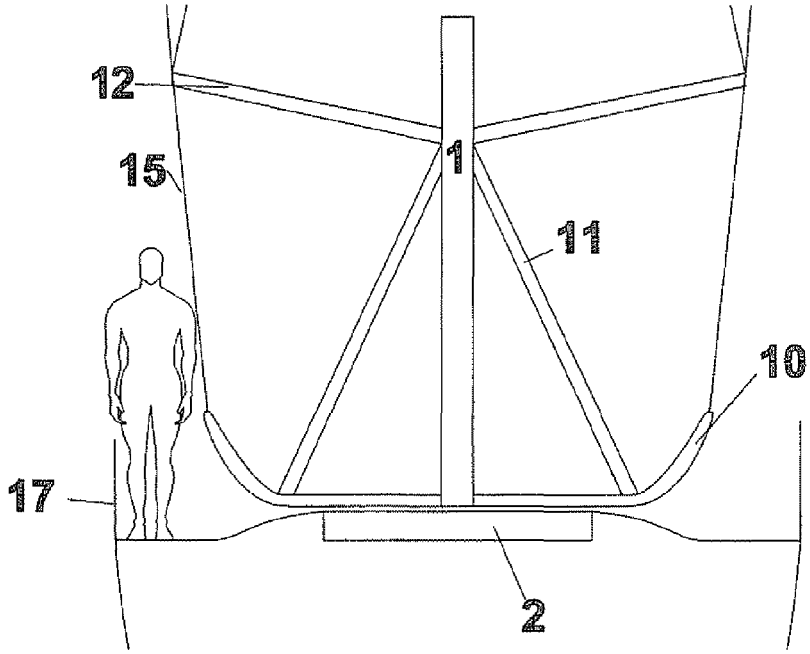

Another point that we want to improve is the rotating shrouds connection to the base platform. In our previous patent (FIG. 4), the rotating shrouds were directly connected to the base platform (2), this made them work very badly because their inclination was too great and because their connection to the platform was not locally reinforced. In order to solve this, and to avoid at the same time having an excessively wide platform, with all the implied drawbacks, we now propose (FIG. 7) a base crosstree (10), solidly connected to the platform. This base crosstree curves upwards at its ends up to the height of the life lines, or even more, so as not to damage the crews shins. At the ends of this crosstree the rotating shrouds are connected (15). It should be as wide as possible as long as people can walk between this crosstree and the stanchions (for example if the beam of the boat at the base area is 4 meters wide, the first crosstree could be up to 3 meters long) (FIG. 7).

There are also two transversal reinforcements (11), that go from each end of the base crosstree to the mast, their job is to absorb the great heeling torques created by the wind on the sails.

Figure 8:
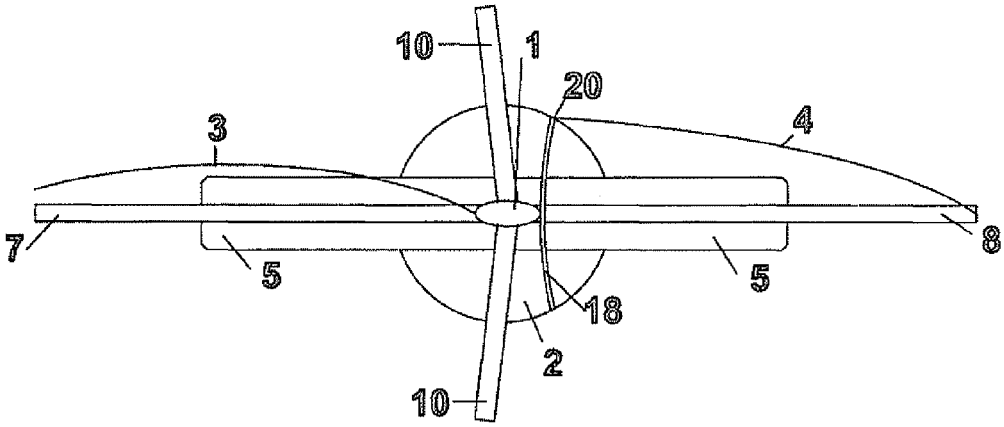

We obtain now what we could call a Cross Rig. (FIG. 8).

As the sails are so near to the deck, not only on this rig but also on the previous one, we are forced to go behind the mainsail or in front of the jib to be able to go from one side to the other of the rig. Moreover, unless we lift or shorten in excess at its forward end the jib's boom, when the rig has rotated 90° it becomes impossible to go to the bow, unless we crawl. (FIG. 6).

Because of this, it seems necessary to have in the proximities of the mast a path allowing a person to go from one side to the other of the rig without having to go all the way round or having to crawl. Actually this not only permits working near the mast but also serves as a refuge where to shelter from the rotation of the rig.

Apparently the easiest solution (FIG. 8) would be to have this path between the mast (1) and the jib's clew (20). Nevertheless, it would only be possible to cross with the jib well open, being also necessary for the jib's sheet traveller (18) to be at level with the platform (2) and for it to be wide enough to allow people to go though. All this, together with the need of having the jib's boom (8) connected to the platform (2), makes this solution too complicated.

Figure 9:
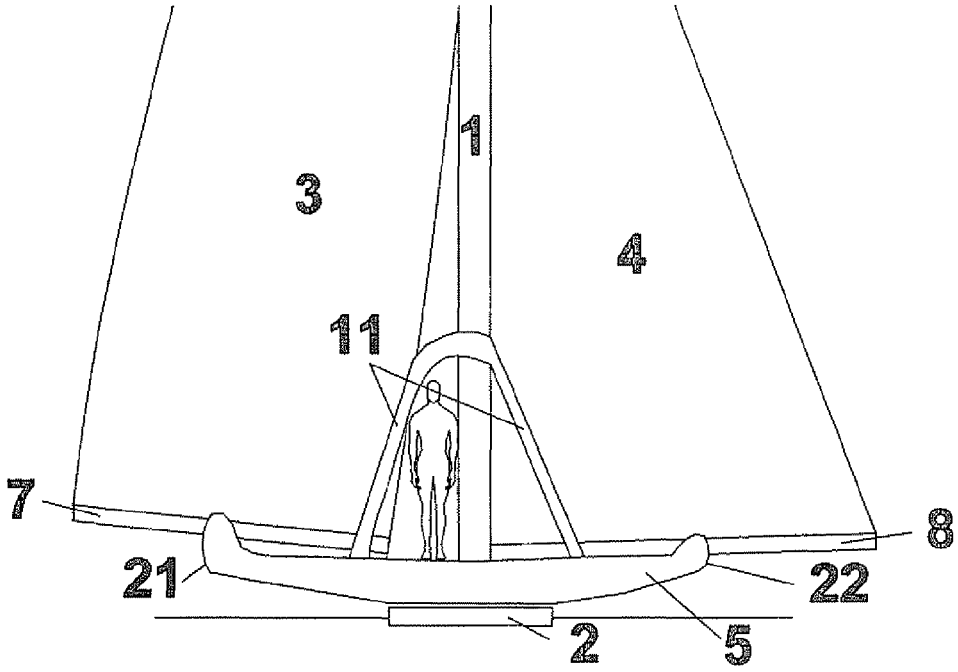

Thus it seems to be much better to separate the mainsail luff (19) from the mast (1) leaving a path between them in the proximities of the deck. Now the jib (4) only needs to open to save the width of the mast. (FIG. 9).

Finally, if we shift the path forward (FIG. 10), stealing room from the mast (1), we could reduce to a minimum the distance between the jib's crew (18) and the main's luff. It would be as if we made a tunnel (13) through the mast. In order not to weaken the structure of the said mast, it is necessary to transversally reinforce its supports over the platform (2).

Figure 10:
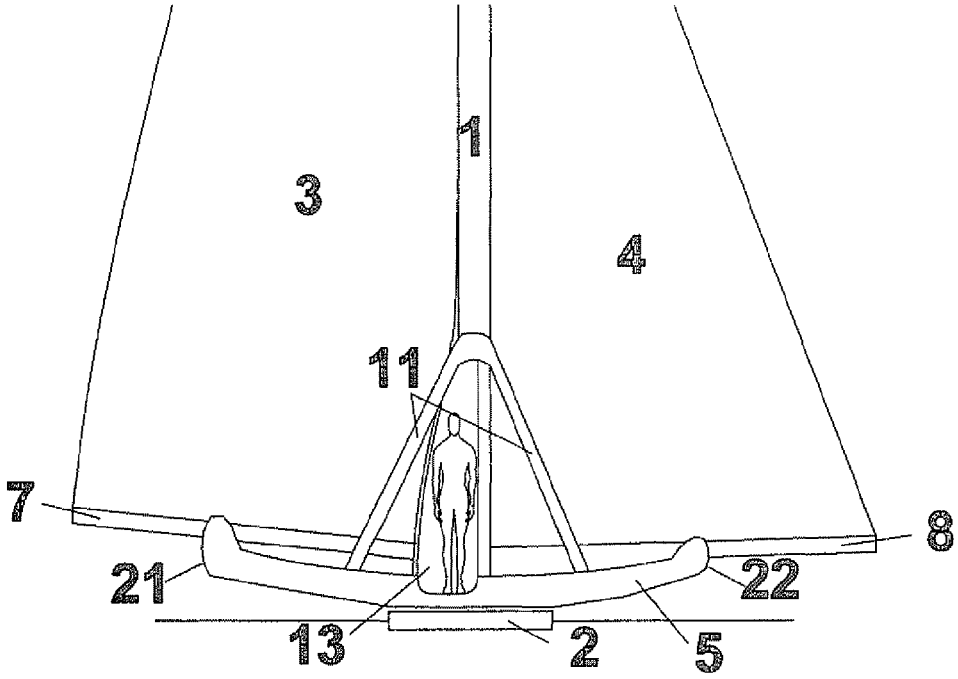

We have got now what we could call Tunnel Rig. (FIG. 10).

3.—ADVANTAGES

These improvements, not only allow us to bring the sails as low as we want and to have a better access to the sails and the booms, but also allow us:

1. To have a very sturdy connection (non punctual) to absorb the great torques of the mainsail and jib, not only thanks to the solid connection (below) between the common boom and the platform, but also thanks to the longitudinal reinforcements which connect the said boom to the mast (above).

2. To be able to adjust the distance to the deck of the mains and jib's boom. And to be able to vary instantly the vertical tension of the sails.
3. To efficiently absorb the heeling torques created by the sails on the mast, thanks to a wide and sturdy base crosstree and to the transversal reinforcements.
4. Avoiding the necessity of having to go round the mainsail or the jib as it is possible to go though the rig near the mast.
5. Not to have to open the jib every time a person wants to go from one side of the rig to the other, and as a consequence, to be able to use smaller platforms.
6. The tunnel through the mast minimizes the separation between mainsail and jib.

4.—POSSIBLE OPTIONS

If the transversal reinforcements (11) are sufficiently separated from the mast and are joined to it higher enough and/or they have a curved shape, they can allow us "a path bow-stern" on top of the platform.

In bigger boats, let us say of more than 30 meters in length, where the height of a person it is no longer important, it would be possible to cross below the rig, by placing the platform (2) on top of a raised rigid structure, or by increasing upwards the thickness of the said platform.

The rotating control of the platform could be placed below decks. This would protect the gear from the weather.

A common boom at the top of the mast would permit increasing the sailing area where the wind is stronger. It would permit a jib wider at the top, even a rectangular one. It would also permit to move forward the sail's centre of effort, and as a consequence a shortening of the jib's boom. This effect could also be achieved by inclining the mast forward.

Middle stays (23) could be used to avoid the mast bending on its middle part. In order to avoid rubbing the sails too much, the connections to the end of the common boom (21 & 22) and to the second crosstree (25) should be separated from the plane of symmetry of the rig. The second crosstree (24) should be reinforced. The head intermediated stay could permit the installation of a smaller jib for a heavy weather.

Another way to install intermediated stays, would be the use of double base crosstrees and first crosstrees, X shaped, with double shrouds, as these shrouds would have a component of tension over the mast parallel to the booms.

Main and jib booms could be replaced by shorter or longer ones depending on the type of navigation that we want to do. They could be telescopic.

As in our previous patent, fixed bow sails could be used for feeble winds.

5.—PREFERRED EMBODIMENT

Next, a Cross and Tunnel Rig can be seen in detail. In this embodiment we incorporated the intermediate stays for the mainsail and jib.

Figure 11:
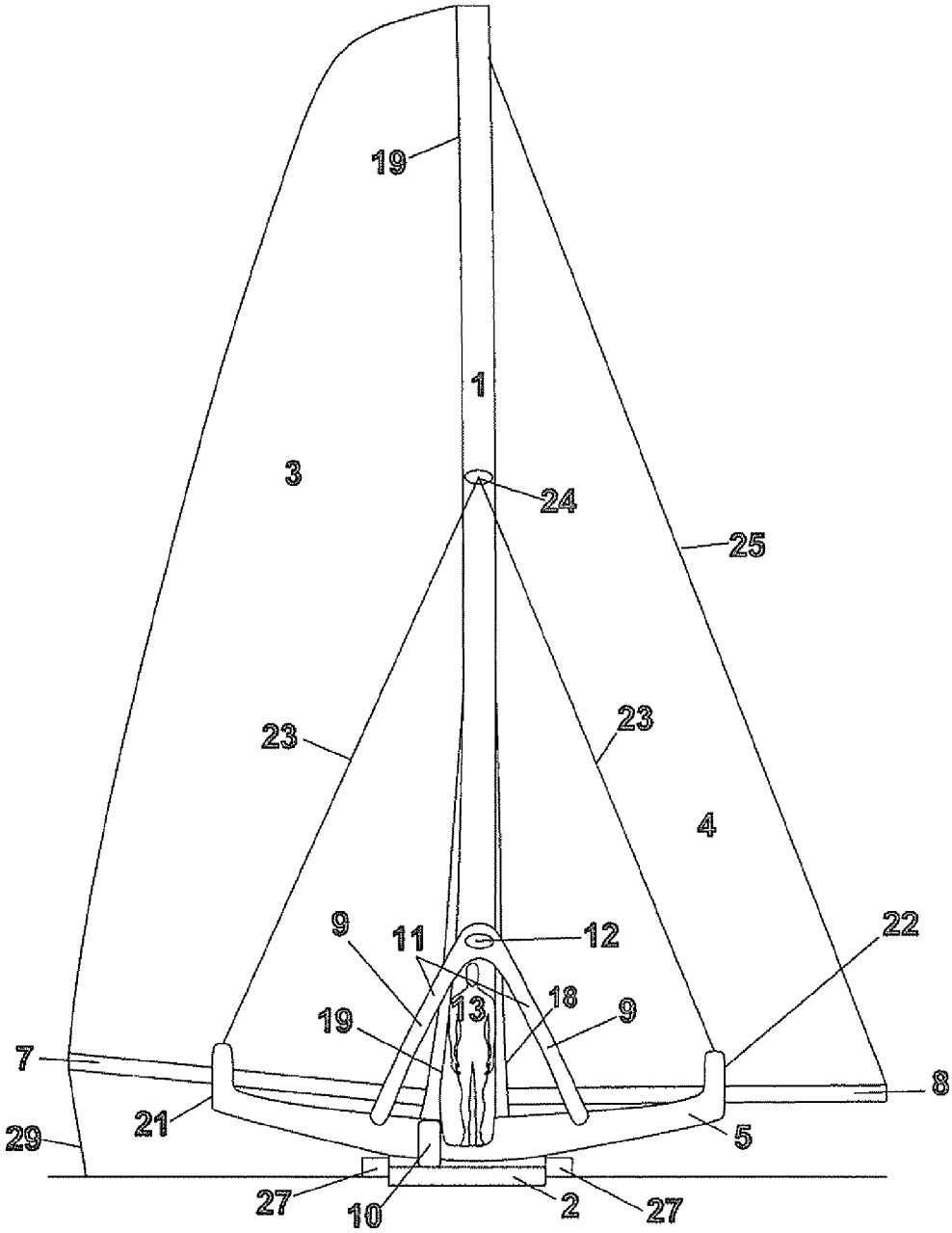

In FIG. 11 we have an elevation vision of this rig. There a person can be seen inside of the tunnel (13). The common boom (5) merges with the base platform (2), and it is reinforced with longitudinal reinforcements (9). The mainsail boom (7) is connected to the posterior extreme of the common boom (21) and to the mast (1), while the jib's boom (8) is connected to its forward extreme (22). These connections permit the up and down movement of the main and jib booms. The main sail (3) is bent to a tuff (19) with constant curvature and to the main sail's boom (7), while the jib (4) is bent to the head stay (25) and the jib's traveller (18). The middle stays (23) are attached below to the posterior part (21) and to the front part (22) of the common boom and above to the second crosstree (24) at a point separated from the mast. It is shown in a schematic mode the connection between the base crosstree (10) and the first crosstree (12), as well as the rotation control mechanism (27) and a backup mainsail sheet (29).

Figure 12:
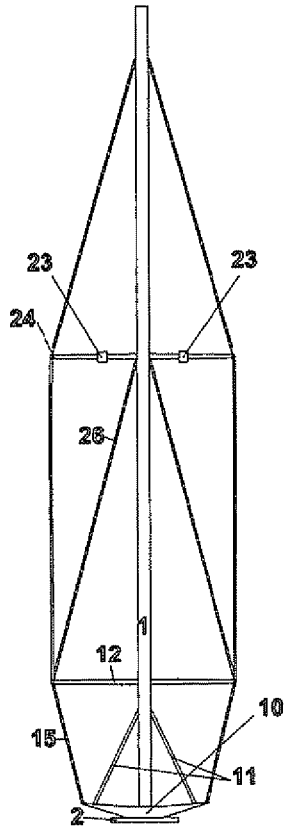

In FIG. 12 we can see a transversal elevation of the rig. There it can be seen that thanks to the base crosstree (10), the rig has a shrouds (15) separation similar to that of the monohull. It can also be seen: the mast (1), the base platform (2), transversal reinforcements (11), first crosstree (12) and second crosstree (24) rotating shrouds (15) and little shrouds (26), and the connexion between middle stays (23) and the second crosstrees.

Figure 13:
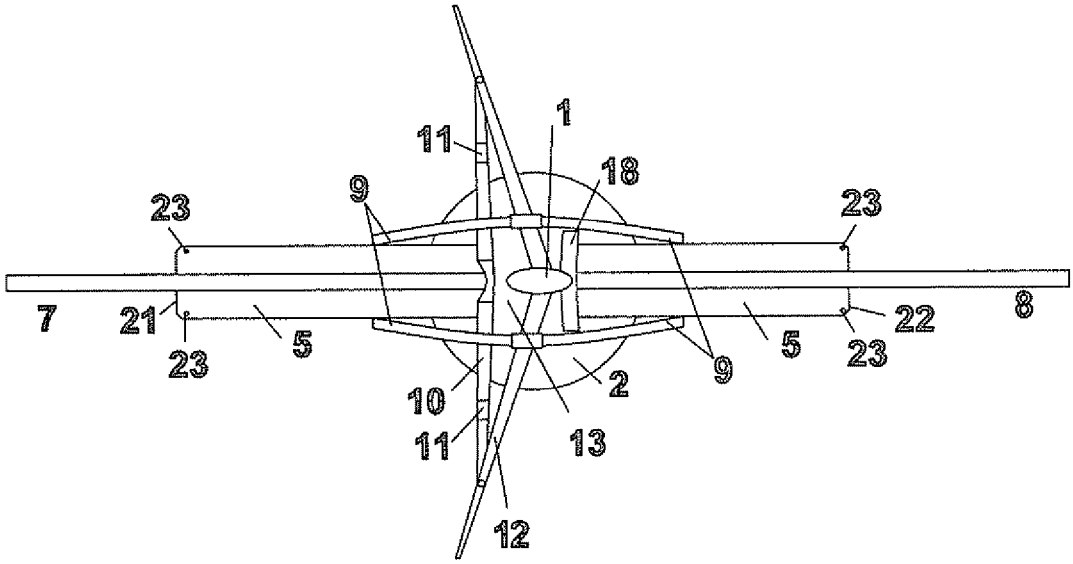

In FIG. 13 we have a plant vision of the rig. There, the already defined elements can be seen: Mast (1) (only the section above the tunnel), platform (2), common boom (5), mainsail boom (7), jib boom (8), as well as longitudinal reinforcements (9) connected below to the common boom (5) and above to the first crosstree (12).

The middle stays (23) are connected to the ends (21) and (22) of the common boom, while the transversal reinfortments (11), not entirely shown in the figure, are connected below to the base crosstree (10) and above to the front part of the mast—tunnel.

As can be seen, the first and second crosstrees have been moved backwards in order to compensate the tensions of the head stays. These crosstrees and their corresponding shrouds and little shrouds are all on the same plane.

The jib sheet traveller (18) is a very short one, because this jib does not need to open, as the whole rig rotates.

We can clearly see the tunnel (13) situated between the base crosstree (10) and the jib sheet traveller (18), and placed below the first crosstree (12) and below the longitudinal reinforcements (9).

And finally we want to make clear that because of the 360° rotation of the rig, transferring the control to the cockpit is more difficult. This problem could partially be resolved by one or some of the following solutions:

a) Coaxial transfer along the mast axis.
b) Telemechanisms (For example to lower the mainsail boom).
c) No transfer, leaving the most frequently used functions at the foot of the mast.
d) Transfer through the mast to the part of the said mast situated inside of the boat's cabin.

This would be of special interest for the typical charter catamarans, where it is very easy to install the rigs control at the front part of the cabin. Even axial access to the deck through the interior of a very thick mast could be installed.

6.—GLOSARY OF TERMS

1.—Mast
2.—Base platform
3.—Main sail
4.—Jib
5.—Common boom
6.—Rig connection
7.—Main sail boom
8.—Jib boom
9.—Longitudinal reinforcements

10.—Base crosstree
11.—Transversal reinforcements
12.—First crosstree
13.—Tunnel
14.—Rotating Stays
15.—Rotating Shrouds
16.—Wishbone booms
17.—Stanchions
18.—Jib sheet traveller
19.—Main sail luff
20.—Jib clew
21.—Common boom posterior end
22.—Common boom front end
23.—Middle stays
24.—Second crosstree
25.—Head stay
26.—Little shrouds
27.—Rotation control mechanism
28.—Articulated junction
29.—Backup main sail sheet

The invention claimed is:

1. In a sailing boat having a hull and a deck, a self-supporting sailing rig comprising:

a base platform (2) rotatably mounted to the deck;

a common boom (5) directly secured to the base platform (2);

a mast (1) secured to the common boom (5), the mast (1) and common boom (5) being rotatable with the base platform (2) about a substantially vertical axis;

a mainsail boom (7) connected to the common boom (5) and to the mast (1);

a jib boom (8) connected to the common boom (5) and to the mast (1);

a mainsail (3) secured to the mast (1) and to the mainsail boom (7) and having a luff (19) adjacent to the mast (1);

a jib (4) secured to the mast (1) and to the jib boom (8) and having a lower corner adjacent to the mast (1) defining a clew (20); and a base crosstree (10) having opposed first and second ends and secured to the base platform (2) generally transverse to the common boom; and first and second shrouds (15) secured to the opposed first and second ends of the base crosstree (10), respectively, to connect the opposed first and second ends of the base crosstree (10) to the mast (1).

2. The self-supporting sailing rig of claim 1 wherein the mainsail luff (19) and the jib clew (20) are spaced from the mast so as to define a path (13) therebetween.

3. The self-supporting sailing rig of claim 2 wherein the path (13) is located between the mainsail luff (19) and the forward-facing portion of the mast (1).

4. The self-supporting sailing rig of claim 1 wherein a forward part of the mainsail boom (7) is secured to the mast (1) and a middle portion of the mainsail boom (7) is secured to the common boom (5) by connections that permit adjustment of vertical spacing of the mainsail boom (7) relative to the deck and inclination of the mainsail boom (7) relative to the mast (1).

5. The self-supporting sailing rig of claim 1 further comprising reinforcements (9) on opposed sides of the mast securing the mast (1) to the common boom (5), the reinforcements (9) being laterally-spaced so that the mainsail (3) and jib (4) may extend therebetween.

6. The self-supporting sailing rig of claim 1 further comprising transverse reinforcements (11) securing the mast (1) to the crosstree (10).

7. The self-supporting sailing rig of claim 1 wherein the sailing boat further comprises stanchions (17) adjacent edges of the deck and the crosstree (10) is sized in length such that its ends are spaced from the stanchions (17) a width sufficient to permit a person to pass between the shrouds (15) and the stanchions (17).

* * * * *